US007454154B2

(12) United States Patent
Matsumoto et al.

(10) Patent No.: US 7,454,154 B2
(45) Date of Patent: Nov. 18, 2008

(54) IMAGE FORMING DEVICE, CHARGING DEVICE AND CLEANING DEVICE

(75) Inventors: Mitsuhiro Matsumoto, Kanagawa (JP); Osamu Handa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 134 days.

(21) Appl. No.: 11/505,402

(22) Filed: Aug. 17, 2006

(65) Prior Publication Data

US 2007/0116490 A1 May 24, 2007

(30) Foreign Application Priority Data

Nov. 18, 2005 (JP) ..... 2005-334168

(51) Int. Cl.
*G03G 15/02* (2006.01)

(52) U.S. Cl. ..... 399/100; 399/176

(58) Field of Classification Search ..... 399/98, 399/99, 100, 174, 176, 343, 357; 15/236.1
See application file for complete search history.

(56) References Cited

U.S. PATENT DOCUMENTS

| | | | | |
|---|---|---|---|---|
| 5,978,616 | A * | 11/1999 | Shin | 399/100 X |
| 6,751,427 | B2 * | 6/2004 | Sugiura | 399/100 |
| 6,873,809 | B2 * | 3/2005 | Amemiya et al. | 399/100 |
| 7,062,194 | B2 * | 6/2006 | Yanagida et al. | 399/100 |
| 7,139,504 | B2 * | 11/2006 | Yanagida et al. | 399/100 |

* cited by examiner

*Primary Examiner*—Sandra L Brase
(74) *Attorney, Agent, or Firm*—Morgan Lewis & Bockius LLP

(57) ABSTRACT

An image forming device has a charging roller including a shaft which is rotatably supported and a cleaning roller that abuts the charging roller. The cleaning roller includes a shaft that is rotatably supported and a porous elastic layer being provided around the shaft. The image forming device satisfies the relation $T\times\alpha/100>(R1+R2)-L>B>0$, where L [mm] is a separation distance of axial centers of both end portions of the shaft of the cleaning roller and the shaft of the charging roller, R1 [mm] is a radius of the charging roller, T [mm] is a thickness of the porous elastic layer, R2 [mm] is a radius of the cleaning roller, B [mm] is a flexure amount of an axial direction central portion of the shaft of the cleaning roller, and $\alpha$ [%] is a maximum allowable compression rate in accordance with a stress-flexure curve.

20 Claims, 8 Drawing Sheets

STRESS-FLEXURE CURVE OF POROUS ELASTIC BODY OF CLEANING ROLLER

IMAGE FORMING DEVICE, CHARGING DEVICE AND CLEANING DEVICE

BACKGROUND

1. Technical Field

The present invention relates to an image forming device, such as a copier or a printer or the like, which employs an electrophotographic method, and more specifically, the present invention relates to a charging device and cleaning device used in an image forming device.

2. Related Art

Conventionally, devices utilizing corona discharge development, such as scorotron chargers, have been used as charging devices of image forming devices such as copiers or printers or the like which employ an electrophotographic method. However, in the case of a charging device which uses corona discharge development, the generating of ozone and nitrogen oxides, which adversely affect human bodies and the global environment, is problematic. In contrast, with a contact-charging method which carries out charging of an image carrier by causing an electrically-conductive charging roller to directly contact an image carrier, the generating of ozone and nitrogen oxides is greatly decreased, and the power efficiency thereof is also good. Therefore, the contact-charging type method has become the mainstream method recently.

SUMMARY

An aspect of the present invention is an image forming device including an image carrier that rotates by receiving driving force, a charging roller that abuts and charges the image carrier, the charging roller including a shaft that is rotatably supported, and a cleaning roller that abuts and cleans the charging roller, the cleaning roller including a shaft that is rotatably supported, and a porous elastic layer being provided around the shaft.

The image forming device satisfies the relation $T\times\alpha/100>(R1+R2)-L>B>0$, where L [mm] is a separation distance of axial centers of both end portions of the shaft of the cleaning roller and the shaft of the charging roller, R1[mm] is a radius of the charging roller, T [mm] is a thickness of the porous elastic layer, R2[mm] is a radius of the cleaning roller, B [mm] is a flexure amount of an axial direction central portion of the shaft of the cleaning roller, and $\alpha$ [%] is a maximum allowable compression rate in accordance with a stress-flexure curve when compressing the porous elastic layer with an applied stress which is 200% of an average stress P [kPa], the average stress P [kPa] being an average value of stresses at compression rates of the porous elastic layer of 10% to 40%.

BRIEF DESCRIPTION OF THE DRAWINGS

An exemplary embodiment of the present invention will be described in detail based on the following figures, wherein.

DETAILED DESCRIPTION

An image forming device relating to an exemplary embodiment of the present invention will be described hereinafter with reference to the drawings.

Figure 1:
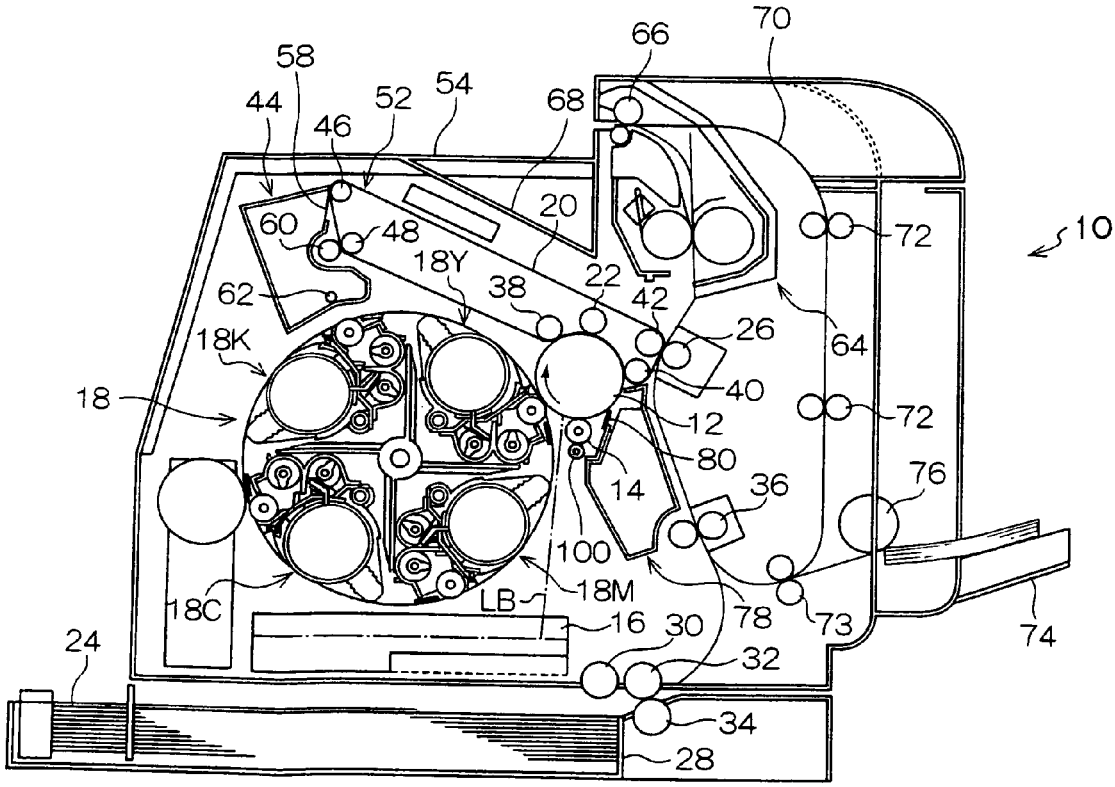
FIG. 1 is a structural diagram showing the schematic structure of an image forming device relating to the exemplary embodiment of the present invention.

An image forming device 10 of the present exemplary embodiment which is shown in FIG. 1 is a four-cycle-type full-color laser printer. As shown in FIG. 1, a photosensitive drum 12 (image carrier) is disposed rotatably within the device, slightly toward the upper right of the center. For example, a structure which is formed from an electrically-conductive cylinder of a diameter of about 47 mm whose surface is covered by a photosensitive layer formed from OPC or the like, is used as the photosensitive drum 12. The photosensitive drum 12 is driven to rotate at a processing speed of about 150 mm/sec along the direction of the arrow by an unillustrated motor.

The surface of the photosensitive drum 12 is charged to a predetermined potential by a charging roller 14 which is disposed substantially directly beneath the photosensitive drum 12. Thereafter, image exposure by a laser beam LB is carried out by an exposure device 16, which is disposed lower than the charging roller 14, such that electrostatic latent images corresponding to image information are formed.

The electrostatic latent images formed on the photosensitive drum 12 are developed by a rotating-type developing device 18, at which developing devices 18Y, 18M, 18C, 18K of the respective colors of yellow (Y), magenta (M), cyan (C), and black (K) are disposed along the peripheral direction, so as to become toner images of predetermined colors.

At this time, the respective processes of charging, exposure, and developing are repeated a predetermined number of times on the surface of the photosensitive drum 12, in accordance with the colors of the image to be formed. In the developing process, the rotating-type developing device 18 is rotated, and the developing devices 18Y, 18M, 18C, 18K of the corresponding colors move to a developing position opposing the photosensitive drum 12.

For example, in a case of forming a full-color image, the respective processes of charging, exposure, and developing are repeated four times on the surface of the photosensitive drum 12 in correspondence with the respective colors of yellow (Y), magenta (M), cyan (C), and black (K), such that toner images corresponding to the respective colors of yellow (Y), magenta (M), cyan (C), and black (K) are successively formed on the surface of the photosensitive drum 12. In forming the toner images, the number of times that the photosensitive drum 12 rotates differs in accordance with the size of the image. For example, in the case of an A4 size image, one image is formed by the photosensitive drum 12 rotating three times. Namely, each time the photosensitive drum 12 rotates three times, toner images corresponding to the respective colors of yellow (Y), magenta (M), cyan (C), and black (K) are formed on the surface of the photosensitive drum 12.

The toner images of the respective colors of yellow (Y), magenta (M), cyan (C), and black (K), which are successively formed on the photosensitive drum 12, are, at a first transfer position where an intermediate transfer belt 20 is trained around the outer periphery of the photosensitive drum 12, transferred by a first transfer roller 22 in a state of being superposed one on another on the intermediate transfer belt 20.

The yellow (Y), magenta (M), cyan (C), and black (K) toner images, which have been transferred in a superposed manner on the intermediate transfer belt 20, are transferred all at once by a second transfer roller 26 onto a recording sheet 24 which is fed at a predetermined time.

On the other hand, the recording sheets 24 are sent-out by a pick-up roller 30 from a sheet feeding cassette 28 disposed at the lower portion of the image forming device 10, and are fed in a state of being separated one-by-one by a feed roller 32 and a retard roller 34. The recording sheet 24 is conveyed by resist rollers 36 to the second transfer position of the intermediate transfer belt 20 in a state of being synchronous with the toner images which have been transferred onto the intermediate transfer belt 20.

The intermediate transfer belt 20 is stretched, at a predetermined tension, between a wrap-in roller 38 which specifies the wrapping position of the intermediate transfer belt 20 at the photosensitive drum 12 at the rotating direction upstream side; the first transfer roller 22 transferring the toner images, which are formed on the photosensitive drum 12, onto the intermediate transfer belt 20; a wrap-out roller 40 specifying the wrapping position of the intermediate transfer belt 20 at the downstream side of the wrapping position; a back-up roller 42 abutting the second transfer roller 26 via the intermediate transfer belt 20; and a first cleaning back-up roller 46 and a second cleaning back-up roller 48 which oppose a cleaning device 44 of the intermediate transfer belt 20. The intermediate transfer belt 20 is, for example, driven accompanying the rotation of the photosensitive drum 12, so as to circulate at a predetermined processing speed (about 150 mm/sec).

Here, in order to make the image forming device 10 compact, the intermediate transfer belt 20 is structured such that the cross-sectional configuration over which the intermediate transfer belt 20 is stretched is a flat, slender, substantial trapezoid.

The intermediate transfer belt 20, together with the photosensitive drum 12, the charging roller 14, the plural rollers 22, 38, 40, 42, 46, 48 over which the intermediate transfer belt 20 is stretched, the cleaning device 44 for the intermediate transfer belt 20, and a cleaning device 78 for the photosensitive drum 12 which will be described later, integrally structure an image forming unit 52. Therefore, by opening a top cover 54 of the image forming device 10 and manually lifting-up a handle (not shown) provided at the top portion of the image forming unit 52, the entire image forming unit 52 can be removed from the image forming device 10.

The cleaning device 44 of the intermediate transfer belt 20 has a scraper 58 which is disposed so as to abut the surface of the intermediate transfer belt 20 stretched by the first cleaning back-up roller 46, and a cleaning brush 60 disposed so as to press-contact the surface of the intermediate transfer belt 20 stretched by the second cleaning back-up roller 48. The residual toner, paper dust, and the like which are removed by the scraper 58 and the cleaning brush 60 are recovered at the interior of the cleaning device 44.

The cleaning device 44 is disposed so as to be able to swing counterclockwise in the figure around a swinging shaft 62. The cleaning device 44 is withdrawn to a position separated from the surface of the intermediate transfer belt 20, up until the second transfer of the toner image of the final color is finished. When the second transfer of the toner image of the final color is finished, the cleaning device 44 abuts the surface of the intermediate transfer belt 20.

The recording sheet 24, on which the toner images have been transferred from the intermediate transfer belt 20, is conveyed to a fixing device 64. The recording sheet 24 is heated and pressurized by the fixing device 64, such that the toner images are fixed onto the recording sheet 24. Thereafter, in the case of singled-sided printing, the recording sheet 24 on which the toner images have been fixed is discharged-out as is by discharge rollers 66 onto a catch tray 68 provided at the top portion of the image forming device 10.

On the other hand, in the case of double-sided printing, the recording sheet 24, on whose first surface (obverse) the toner images have been fixed by the fixing device 64, is not discharged-out as is onto the catch tray 68 by the discharge rollers 66. In a state in which the trailing end portion of the recording sheet 24 is nipped by the discharge rollers 66, the discharge rollers 66 are rotated reversely. The conveying path of the recording sheet 24 is switched to a sheet conveying path 70 for double-sided printing. In a state in which the obverse and reverse of the recording sheet 24 are reversed, the recording sheet 24 is again conveyed to the second transfer position of the intermediate transfer belt 20 by conveying rollers 72 disposed at the sheet conveying path 70 for double-sided printing, and toner images are transferred onto the second surface (the reverse) of the recording sheet 24. Then, the toner images of the second surface (reverse) of the recording sheet 24 are fixed by the fixing device 64, and the recording sheet 24 is discharged-out onto the catch tray 68.

As an option at the image forming device 10, a manual feed tray 74 can be attached to the side surface of the image forming device 10 so as to be freely opened and closed. The recording sheet 24 of an arbitrary size and type which is placed on this manual feed tray 74 is fed by a feed roller 76, and is conveyed to the second transfer position of the intermediate transfer belt 20 via conveying rollers 73 and the resist rollers 36. An image can thereby be formed as well on the recording sheet 24 of an arbitrary size and type.

Each time the photosensitive drum 12 rotates one time, residual toner and paper dust and the like are removed from the surface of the photosensitive drum 12, after the transfer process of the toner images has been completed, by a cleaning blade 80 of the cleaning device 78 which is disposed obliquely beneath the photosensitive drum 12, so as to prepare for the next image forming process.

Figure 2:
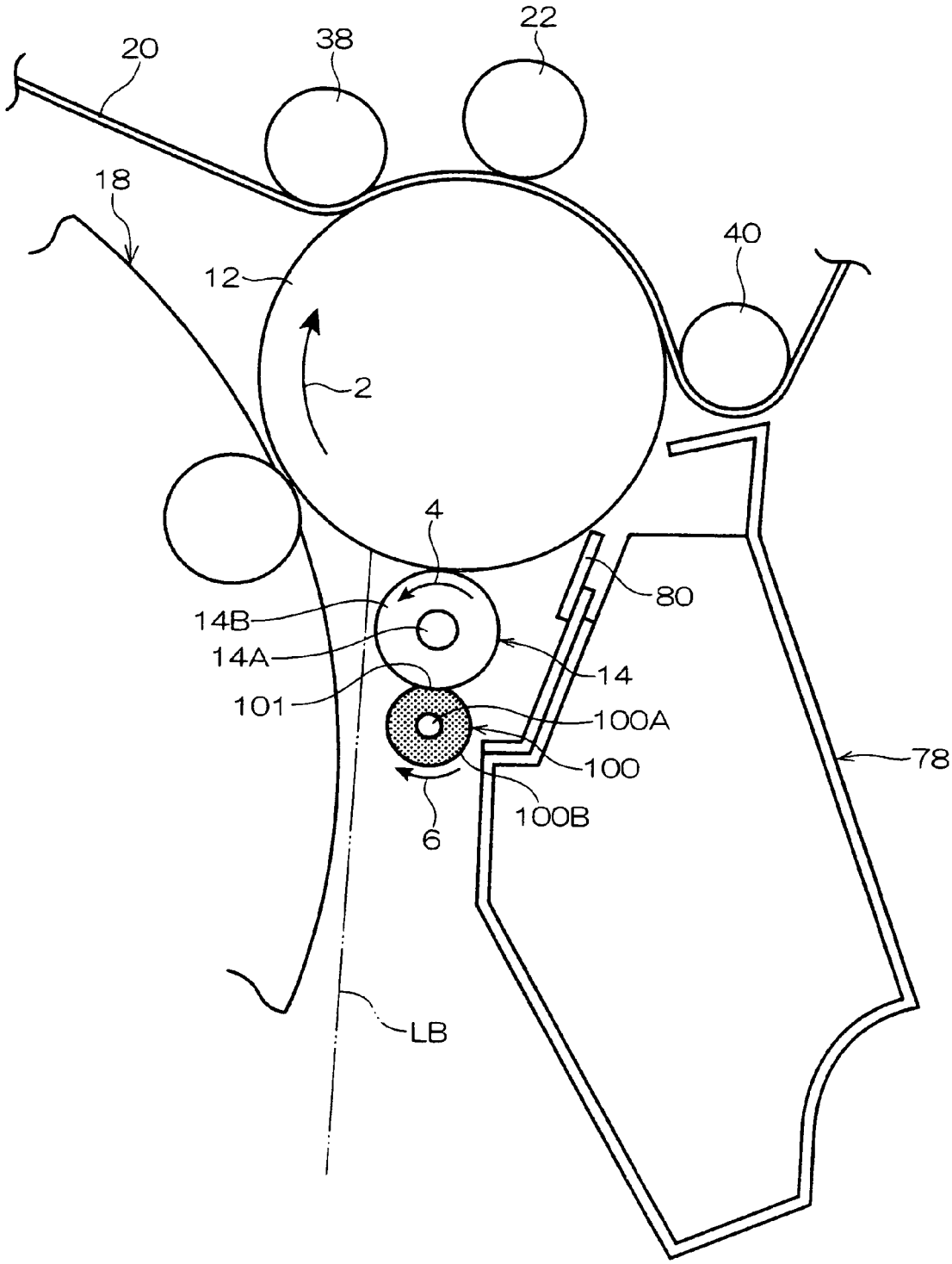
FIG. 2 is an enlarged view showing the structures of a photosensitive drum, a charging roller, and a cleaning roller provided in the image forming device of FIG. 1.

As shown in FIG. 2, the charging roller 14 is disposed beneath the photosensitive drum 12, so as to contact the photosensitive drum 12. The charging roller 14 is structured such that a charging layer 14B is formed on the periphery of an electrically-conductive shaft 14A, and the shaft 14A is supported rotatably. A cleaning roller 100, which is shaped as a roller and which contacts the surface of the charging roller 14, is provided beneath the charging roller 14 at the side opposite the photosensitive drum 12. The cleaning roller 100 is structured such that a sponge layer 100B (a porous elastic layer) is formed on the periphery of shaft 100A, and the shaft 100A is supported rotatably.

The cleaning roller 100 is pushed against the charging roller 14 at a predetermined load, such that the sponge layer 100B elastically deforms along the peripheral surface of the charging roller 14 and forms a nip portion 101. The photosensitive drum 12 is driven to rotate clockwise in FIG. 2 (in the direction of arrow 2) by an unillustrated motor, and, due to the rotation of the photosensitive drum 12, the charging roller 14 is rotated in the direction of arrow 4. Further, due to the rotation of the charging roller 14, the roller-shaped cleaning roller 100 is rotated in the direction of arrow 6.

A power source for charging is connected to the charging roller 14. A bias in which alternating current is superimposed on direct current, or direct current bias only, is applied to the charging roller 14. On the other hand, although the application of bias to the cleaning roller 100 is not particularly prescribed, in the present invention, the shaft 14A of the charging roller 14 and the shaft 100A of the cleaning roller 100 are rotatably supported at the same shaft-receiving members (as will be described later), and the cleaning roller 100 is the same potential as the charging roller 14.

Due to the cleaning roller 100 being rotated, the contamination (foreign matter), such as toner and external additives and the like, adhering to the surface of the charging roller 14 is cleaned by the cleaning roller 100. Then, this foreign matter is taken-in into the cells of the foam of the cleaning roller 100. When the foreign matter recovered within the cells coheres and becomes a proper size, the foreign matter is returned from the cleaning roller 100 to the photosensitive drum 12 via the charging roller 14, and is recovered at the cleaning device 78 which cleans the photosensitive drum 12. The cleaning performance is thereby maintained and continued.

Free-cutting steel, stainless steel, or the like is used as the material of the shaft 100A of the cleaning roller 100. The material and the surface treatment method thereof are selected as occasion demands in accordance with the application, such as slidability or the like. A material which is not electrically-conductive may be made electrically-conductive by being subjected to a general processing such as plating or the like, or may of course be used as is. Further, because the cleaning roller 100 contacts the charging roller 14 via the sponge layer 100B at a proper nipping pressure, a material having strength such that it does not flex at the time of nipping, or a shaft diameter having sufficient rigidity with respect to the shaft length, is selected.

The sponge layer 100B is formed from a foam having a porous, three-dimensional structure. The material of the sponge layer 100B is selected from foamed resin or rubber such as polyurethane, polyethylene, polyamide, polypropylene or the like. Polyurethane, which is strong in terms of tear strength, tensile strength, and the like, is particularly preferably used so that the sponge layer 100B efficiently cleans foreign matter such as external additives and the like by sliding and rubbing against the charging roller 14, and at the same time, the surface of the charging roller 14 is not scratched due to the rubbing of the sponge layer 100B, and also so that tearing and breakage do not arise over a long period of time.

At the charging roller 14, an electrically-conductive elastic layer and a surface layer are formed successively as the charging layer 14B on the electrically-conductive shaft 14A.

Free-cutting steel, stainless steel, or the like is used as the material of the shaft 14A. The material and the surface treatment method thereof are selected as occasion demands in accordance with the application, such as slidability or the like. A material which is not electrically-conductive may be made electrically-conductive by being subjected to a general processing such as plating or the like.

For example, elastic materials such as rubbers or the like which are elastic, electrically-conductive materials such as carbon black or ionic electrically-conductive materials or the like which adjust the resistance of the electrically-conductive elastic layer, and as needed, materials which can usually be added to rubber such as softening agents, plasticizers, hardening agents, vulcanizing agents, vulcanization accelerators, antioxidants, fillers such as silica and calcium carbonate and the like, and the like may be added to the aforementioned electrically-conductive elastic layer which structures the charging layer 14B of the charging roller 14. The electrically-conductive elastic layer is formed by covering the peripheral surface of the electrically-conductive shaft 14A with a mixture to which is added materials usually added to rubber. A substance in which a material that conducts electricity, in which electrons and/or ions acting as a charge carrier, are dispersed therein, such as carbon black or an ionic electrically-conductive agent compounded in a matrix material, or the like can be used as an electrically-conductive agent for the purpose of adjusting the resistance value. Further, the aforementioned elastic material may be a foam.

The aforementioned surface layer structuring the charging layer 14B is formed in order to prevent contamination by foreign matter such as toner and the like, and the like. The material of the surface layer is not particularly limited, and any of resins, rubbers, or the like may be used. Examples include polyester, polyimide, copolymer nylon, silicone resins, acrylic resins, polyvinylbutyral, ethylene-tetrafluoroethylene copolymers, melamine resins, fluororubbers, epoxy resins, polycarbonate, polyvinyl alcohol, cellulose, Polyvinylidene chloride, polyvinyl chloride, polyethylene, ethylene-vinyl acetate copolymers, and the like.

The resistance value can be adjusted by including an electrically-conductive material in the surface layer. Materials having a particle diameter of less than or equal to 3 μm are desirably used as this electrically-conductive material.

A substance in which a material that conducts electricity, in which electrons and/or ions acting as a charge carrier are dispersed therein, such as carbon black or electrically-conductive metal oxide particles or an ionic electrically-conductive agent which are compounded in a matrix material, or the like can be used as an electrically-conductive agent whose purpose is to adjust the resistance value.

The electrically-conductive metal oxide particles, which are electrically-conductive particles for adjusting the resistance value, are particles which are electrically-conductive such as tin oxide, antimony-doped tin oxide, zinc oxide, anatase-type titanium oxide, ITO, and the like. Provided that the electrically-conductive metal oxide particles are an electrically-conductive agent which makes electrons be a charged carrier, any substance may be used and the substance is not particularly limited. These substances may be used alone, or two or more types thereof may be used in combination. Further, the particle diameter may be any particle diameter provided that it does not adversely affect the present invention. From the standpoints of adjusting the resistance value and strength, tin oxide, antimony-doped tin oxide, and anatase-type titanium oxide are preferable, and tin oxide and antimony-doped tin oxide are more preferable.

By carrying out control of the resistance by such an electrically-conductive material, the resistance value of the surface layer does not vary in accordance with the environment conditions, and a stable characteristic is obtained.

A fluorine resin or silicone resin is used as the aforementioned surface layer. It is particularly preferable that the surface layer be structured of a fluorine-modified acrylate polymer. Further, particulates may be added in the surface layer. In this way, the surface layer becomes hydrophobic, and works to prevent the adhering of foreign matter to the charging roller 14. In addition, insulating particles such as alumina or silica can be added so as to provide the surface of the charging roller 14 with convexity and concavity, and make the burden at the time of sliding and rubbing against the photosensitive drum 12 small, and improve the mutual wear resistances of the charging roller 14 and the photosensitive drum 12.

Next, a mounting structure of the charging roller 14 and the cleaning roller 100 will be described in detail.

Figure 3:
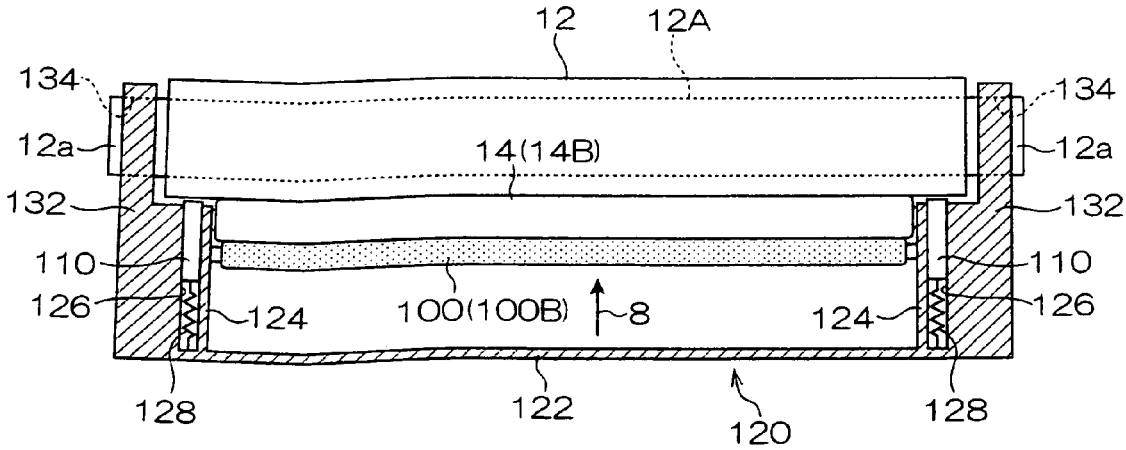
FIG. 3 is a partial sectional side view showing a mounting structure of the photosensitive drum, the charging roller, and the cleaning roller of the image forming device relating to the exemplary embodiment of the present invention.

As shown in FIG. 3, in the present exemplary embodiment, the charging roller 14 and the cleaning roller 100 are assembled to a single frame 120 via a pair of shaft-receiving members 110, and are accommodated inside the frame 120. The photosensitive drum 12 as well is assembled to the frame 120, such that these members are made into a unit.

Figure 4B:
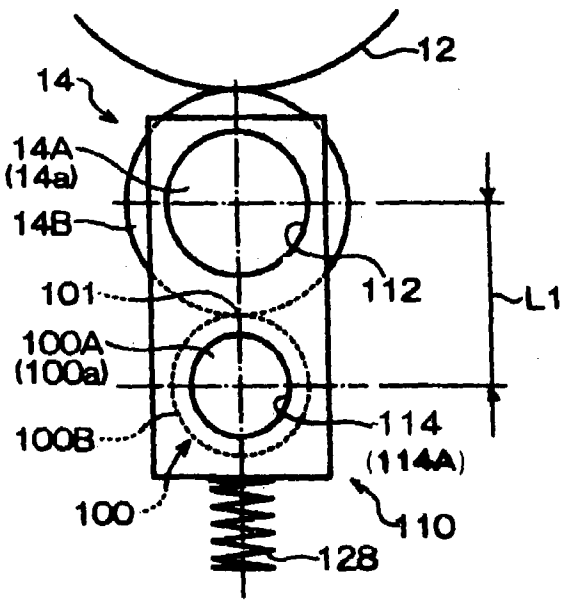
FIG. 4A is a perspective view and FIG. 4B is a side view showing a state in which the charging roller and the cleaning roller structuring the image forming device relating to the exemplary embodiment of the present invention are rotatably supported at a shaft-receiving member.
Figure 4A:
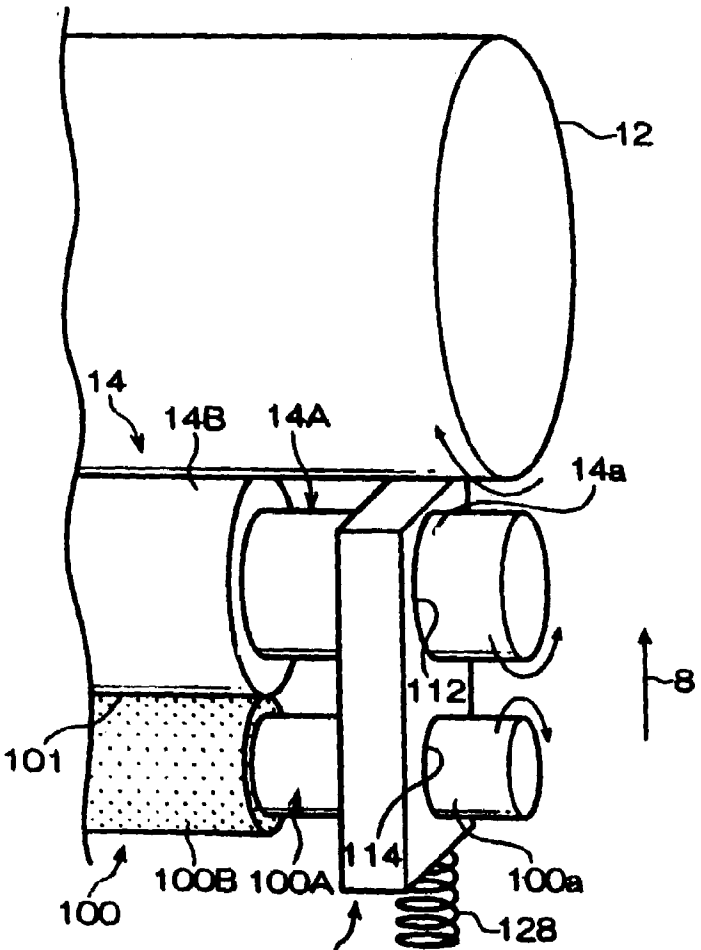

As shown in FIGS. 4A and 4B, each one of the shaft-receiving members 110 is formed in the shape of a flat rectangular parallelepiped (the shape of a block), and is a single structure. The shaft-receiving member 110 is formed of a synthetic resin material such as polyacetal or polycarbonate or the like having high rigidity, good slidability, and excellent wear-resistance. In order to further improve the wear-resistance, glass fibers or carbon fibers or the like may be contained in the synthetic resin material.

Two shaft-receiving holes 112, 114, which are disposed at a predetermined interval along the longitudinal direction (the vertical direction in FIGS. 4A and 4B), are formed in the shaft-receiving member 110. A supporting portion 14*a* provided at an end portion of the shaft 14A of the charging roller 14 is rotatably inserted through the one shaft-receiving hole 112. A supporting portion 100*a* provided at an end portion of the shaft 100A of the cleaning roller 100 is rotatably inserted through the other shaft-receiving hole 114. Further, as illustrated, the inner diameter of the shaft-receiving hole 114 is formed to be larger than the shaft diameter of the shaft 100A (the supporting portion 100*a*).

The relative positions of the charging roller 14, at which the supporting portions 14*a* at the both ends of the shaft 14A are rotatably supported at the pair of shaft-receiving members 110, and the cleaning roller 100, at which the supporting portions 100*a* at the both ends of the shaft 100A are rotatably supported at the pair of shaft-receiving members 110, are maintained substantially constant (at a spacing dimension of L1 between centers of the shafts 100A and 14A) due to the supporting portions 100*a* of the shaft 100A of the cleaning roller 100 abutting and being supported by inner peripheral surface portions 114A of the shaft-receiving holes 114 at the side opposite the charging roller 14, due to the cleaning roller 100 being pushed against the charging roller 14 at a predetermined load. As described above, the sponge layer 100B elastically deforms along the peripheral surface of the charging roller 14 so as to form the nip portion 101 (see FIG. 2). The shaft-receiving holes 114, which abut and support the supporting portions 100*a* of the shaft 100A of the cleaning roller 100 in this way, are configurations which provide the supporting portions 100*a* of the shaft 100A with a degree of freedom in the direction of press-contacting the charging roller 14 (the direction of arrow 8).

As shown in FIG. 3, a pair of mounting portions 124, to which the above-described pair of shaft-receiving members 110 are mounted, are provided integrally at a main body portion 122 of the frame 120, at the both end portions (the left and right side end portions in FIG. 3) along the axial direction of the charging roller 14 and the cleaning roller 100.

Guide grooves 126, which run along the direction in which the mounting portions 124 extend, are formed in the mounting portions 124. The shaft-receiving members 110 are fit-into the guide grooves 126, are disposed at the distal end sides thereof, and can slide along the direction in which the mounting portions 124 extend (directions of approaching and moving away from the photosensitive drum 12) while being guided by the guide grooves 126.

The outer side surface sides of the pair of mounting portions 124 are formed to be thick, and the distal end sides thereof extend-out. A pair of shaft-receiving portions 132, which rotatably support the photosensitive drum 12, are provided at the distal end portions thereof. Shaft-receiving holes 134 are formed coaxially in the pair of shaft-receiving portions 132. Supporting portions 12*a*, which are provided at the end portions of the shaft 12A, are rotatably inserted through the shaft receiving holes 134, and the photosensitive drum 12 is, together with the charging roller 14 and the cleaning roller 100, assembled to the frame 120.

Compression coil springs 128, which urge the shaft-receiving members 110 toward the photosensitive drum 12, are provided at the proximal end sides within the guide grooves 126. Due to the spring forces of these compression coil springs 128, the shaft-receiving members 110 are urged toward the photosensitive drum 12 (in the direction of arrow 8), and the charging roller 14 press-contacts the photosensitive drum 12. In this way, when the photosensitive drum 12 rotates, the charging roller 14 is rotated accompanying the rotation of the photosensitive drum 12, and charges the photosensitive drum 12. Further, the cleaning roller 100 is rotated accompanying the rotation of the charging roller 14, and cleans the charging roller 14.

Operation of the present exemplary embodiment will be described next.

Figure 5:
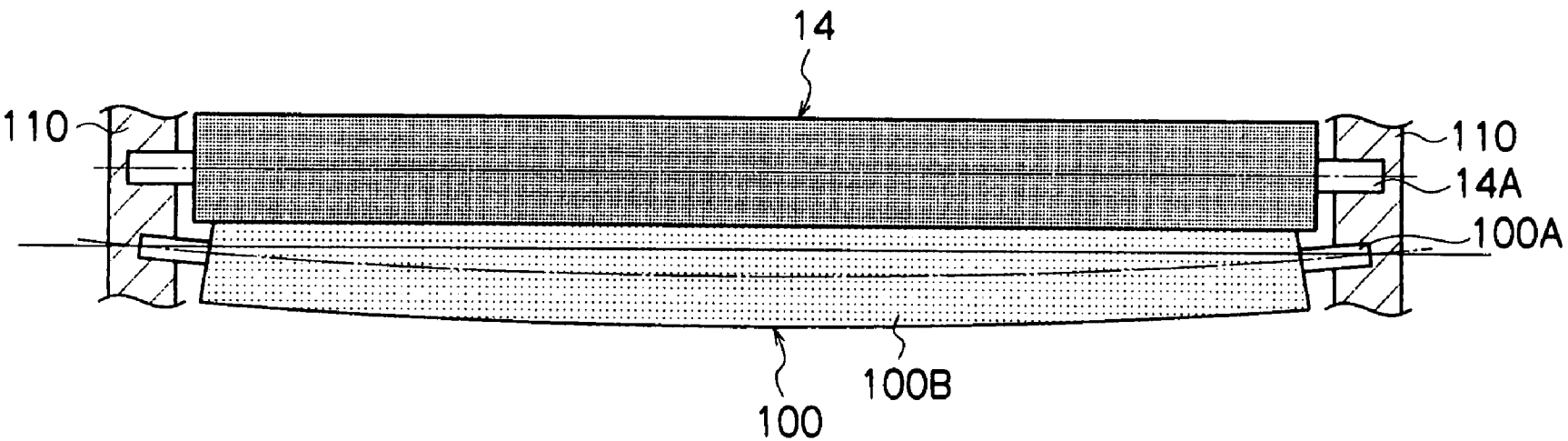
FIG. 5 is an explanatory diagram showing rotatably supported states of the charging roller and the cleaning roller structuring the image forming device relating to the exemplary embodiment of the present invention.
Figure 6:
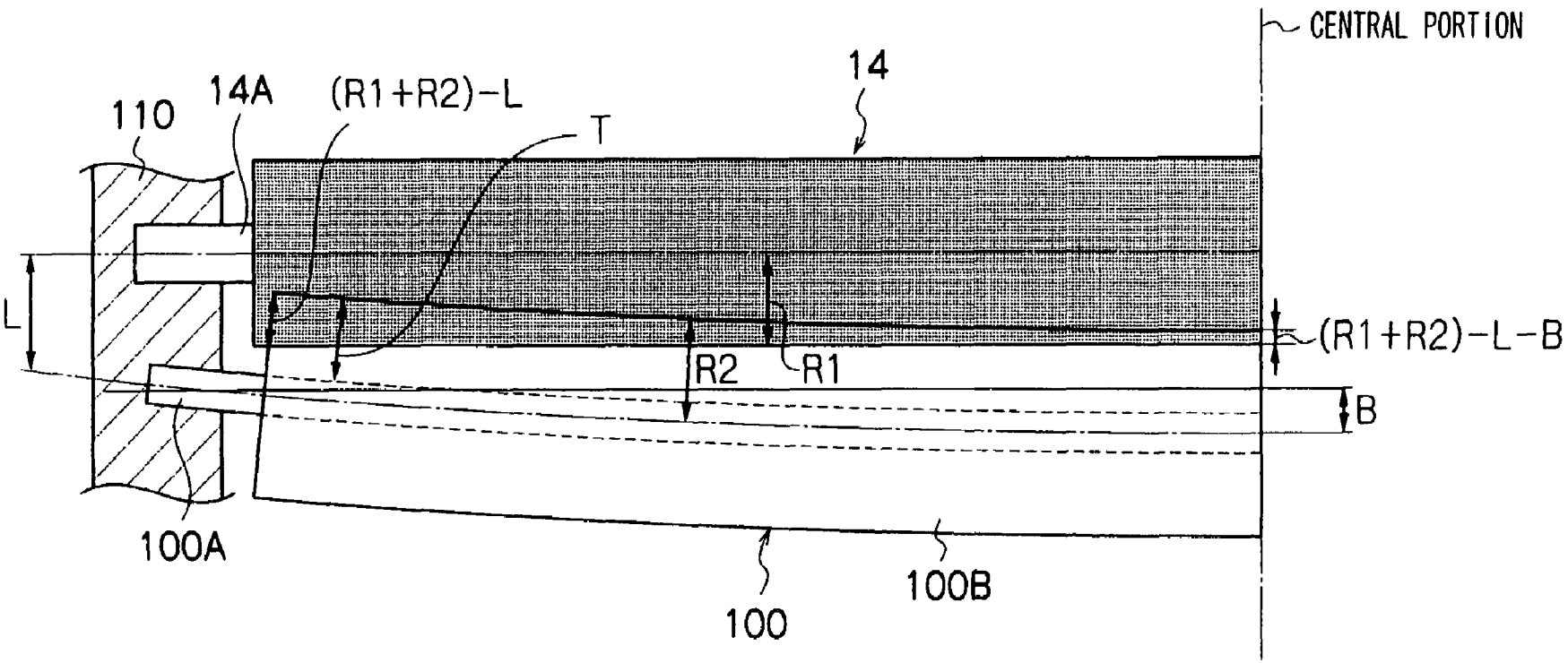
FIG. 6 is an enlarged view of FIG. 5.

As shown in FIGS. 5 and 6 (FIG. 6 is an enlarged view of FIG. 5), because the cleaning roller 100 is made to press-contact the charging roller 14, flexure arises at the cleaning roller 100 due to this press-contact force.

Figure 7:
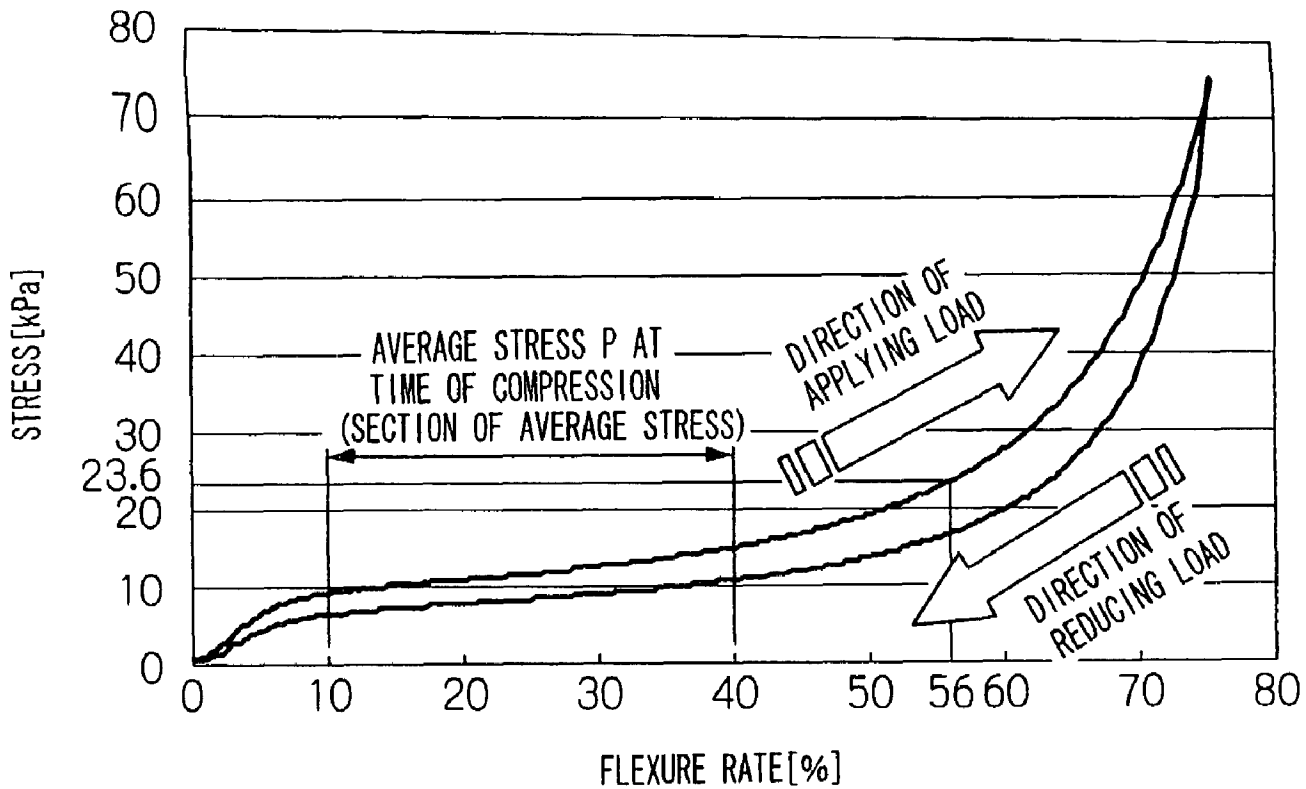
FIG. 7 is a graph showing a stress-flexure curve of a porous elastic body used at the cleaning roller structuring the image forming device relating to the exemplary embodiment of the present invention.

FIG. 7 shows a stress-flexure curve of the porous elastic body used as the sponge layer 100B of the cleaning roller 100. A metal disc of $\phi$50 mm is made to have interference with a bulk-like porous elastic body (RR80 manufactured by Inoac Corporation is used) of 50×380×380 mm. The stress corresponding to the interference is measured, and the relationship between this stress and the flexure rate (also called compression rate) is determined.

In this stress-flexure curve, there is hysteresis in the direction of increasing the interference of the porous elastic body (the direction of applying load: the direction in which the flexure rate increases) and in the direction of reducing the interference (the direction of removing load: the direction in which the flexure rate decreases). Because the stress values with respect to the flexure amounts are greater in the direction of applying load, the curve at the time of applying load is used in computing a maximum allowable compression rate $\alpha$.

Here, in the 10 to 40% range of the flexure rate of the porous elastic body, the porous elastic body which is the object of measurement exhibits the mechanical characteristic of a so-called sponge (i.e., the stress value does not increase even if the interference increases).

Therefore, the cells of the porous elastic body are compressed and become a substantially crushed state, at the compression rate of the porous elastic body at the time of applying a stress which corresponds to 200% of average stress P [kPa] where the flexure rate of the porous elastic body is 10% to 40% (simply called "average stress P" on occasion hereinafter).

At stresses corresponding to greater than or equal to 200% of the average stress P [kPa], permanent compressive strain arises, and external additives cannot be taken-into the cells of the porous elastic body. The cleaning function of the external additives and toner on the charging roller cohering within the cells of the porous elastic body and being returned to the charging roller and the photosensitive drum, can no longer be exhibited. Therefore, when determining the maximum allowable compression rate α, the limit stress applied to the porous elastic body is stress corresponding to 200% of the average stress P.

Concretely, average stress P=11.8 [kPa] is determined from the average value of the stress values in the 10% to 40% range of the flexure rate of the porous elastic body. Stress P', which is 200% of this average value P [kPa], is P×200[%]/100=23.6 [kPa]. The compression rate corresponding to P', i.e., the maximum allowable compression rate α, is 56%.

Here, if the interference of the sponge layer 100B is too large, the resistance of the charging roller 14 rises, and trouble such as stripes being formed on a print sample, or the like, arise, and there is also the problem that the lifespan of the charging roller 14 is shortened.

Therefore, the interference ((R1+R2)−L) of the sponge layer 100B into the charging roller 14 must be smaller than the interference (T×α/100, where T is the thickness of the sponge layer 100B) which is obtained on the basis of the maximum allowable compression rate α. Namely, T×α/100>(R1+R2)−L.

Table 1 shows the cleaning performance in the axial direction of the charging roller 14 under respective conditions when dimensions, such as the outer diameter of the cleaning roller 100 and the like, are changed in Examples 1 through 5.

TABLE 1

| | parameters of cleaning roller | | | | | | colors stripes in halftone image | | roller contamination | | |
|---|---|---|---|---|---|---|---|---|---|---|---|
| | cleaning roller outer diameter (mm) | cleaning roller shaft outer diameter (mm) | sponge layer thickness (mm) | interference (mm) | compression rate (%) of sponge layer end portions | compression rate (%) of sponge layer central portions | region of 100 (mm) width from end portion of charging roller | region of 100 (mm) width at central portion of charging roller | region of 100 (mm) width from end portion of charging roller | region of 100 (mm) width at central portion of charging roller | judgment |
| Ex. | ϕ10 | ϕ6 | 2 | 0.25 | 13% | 4% | ○ | Δ | ○ | Δ | Δ |
| 1 | ↑ | ↑ | ↑ | 0.5 | 25% | 10% | ○ | ○ | ○ | ○ | ○ |
| | ↑ | ↑ | ↑ | 0.75 | 38% | 17% | ○ | ○ | ○ | ○ | ○ |
| | ↑ | ↑ | ↑ | 1 | 50% | 25% | ○ | ○ | ○ | ○ | ○ |
| | ↑ | ↑ | ↑ | 1.12 | 56% | 29% | x | ○ | ○ | ○ | x |
| | ↑ | ↑ | ↑ | 1.25 | 63% | 35% | x | ○ | Δ | ○ | x |
| Ex. | ϕ9 | ϕ5 | ↑ | 0.25 | 13% | 2% | ○ | x | ○ | x | x |
| 2 | ↑ | ↑ | ↑ | 0.5 | 25% | 5% | ○ | Δ | ○ | Δ | Δ |
| | ↑ | ↑ | ↑ | 0.75 | 38% | 9% | ○ | ○ | ○ | ○ | ○ |
| | ↑ | ↑ | ↑ | 1 | 50% | 14% | ○ | ○ | ○ | ○ | ○ |
| | ↑ | ↑ | ↑ | 1.12 | 56% | 17% | x | ○ | ○ | ○ | x |
| | ↑ | ↑ | ↑ | 1.25 | 63% | 20% | x | ○ | Δ | ○ | x |
| Ex. | ϕ8 | ϕ4 | ↑ | 0.25 | 13% | 1% | ○ | x | ○ | x | x |
| 3 | ↑ | ↑ | ↑ | 0.5 | 25% | 2% | ○ | x | ○ | x | x |
| | ↑ | ↑ | ↑ | 0.75 | 38% | 3% | ○ | x | ○ | x | x |
| | ↑ | ↑ | ↑ | 1 | 50% | 4% | ○ | Δ | ○ | Δ | Δ |
| | ↑ | ↑ | ↑ | 1.12 | 56% | 5% | x | ○ | ○ | ○ | x |
| | ↑ | ↑ | ↑ | 1.25 | 63% | 6% | x | ○ | Δ | ○ | x |
| Ex. | ϕ11 | ϕ5 | 3 | 0.25 | 8% | 2% | x | x | Δ | x | x |
| 4 | ↑ | ↑ | ↑ | 0.5 | 17% | 5% | ○ | Δ | ○ | Δ | Δ |
| | ↑ | ↑ | ↑ | 0.75 | 25% | 8% | ○ | ○ | ○ | ○ | ○ |
| | ↑ | ↑ | ↑ | 1 | 33% | 12% | ○ | ○ | ○ | ○ | ○ |
| | ↑ | ↑ | ↑ | 1.25 | 42% | 17% | ○ | ○ | ○ | ○ | ○ |

TABLE 1-continued

| | | | | | | | | | | | |
|---|---|---|---|---|---|---|---|---|---|---|---|
| Ex. | ϕ10 | ϕ4 | ↑ | 0.25 | 8% | 2% | x | x | Δ | x | x |
| 5 | ↑ | ↑ | ↑ | 0.5 | 17% | 3% | ○ | x | ○ | x | x |
| | ↑ | ↑ | ↑ | 0.75 | 25% | 6% | ○ | ○ | ○ | ○ | ○ |
| | ↑ | ↑ | ↑ | 1 | 33% | 10% | ○ | ○ | ○ | ○ | ○ |
| | ↑ | ↑ | ↑ | 1.25 | 42% | 14% | ○ | ○ | ○ | ○ | ○ |

In the present Examples, the outer diameter of the charging roller 14 is ϕ14, the outer diameter of the shaft 14A of the charging roller 14 is ϕ8, and the outer diameter of the cleaning roller 100 is ϕ10, ϕ9, ϕ8. The thickness T of the sponge layer 100B, whose material was RR80, of the cleaning roller 100 is 2 mm, 3 mm. The outer diameter of the shaft 100A of the cleaning roller 100 is made to be ϕ6, ϕ5, ϕ4 in accordance with the outer diameter of the cleaning roller 100.

These cleaning rollers 100 are installed in an image forming device manufactured by Fuji Xerox Co., Ltd. 50,000 sheets are printed in a high temperature and high humidity environment (28° C., 85%), and thereafter, a printing test in a low temperature and low humidity environment (11° C., 15%) is carried out. The image quality is evaluated on the basis of the following criteria in accordance with the absence/presence of color stripes in a halftone image for the low temperature and low humidity environment after the passage of the 50,000 sheets.

○: no defects such as color stripes or the like

Δ: very slight color stripes generated x: color stripes generated

Further, the evaluation of contamination of the charging roller 14 is carried out visually on the basis of the following criteria for the charging roller after the passage of the 50,000 sheets.

○: hardly any adhesion of foreign matter x: local adhesion of slight foreign matter (white portions and black portions can be faintly seen on the roller)

x: local fixing of foreign matter (white portions and black portions can distinctly be seen on the roller)

Here, "Δ" in the evaluations means a level that hardly causes any problems at all, and "○" is more preferable.

In cases of the conditions of the shaded regions in Table 1, i.e., the maximum compression rate a of the sponge layer 100B being less than 56% (the maximum interference being less than 0.56 T) and the compression rate of the central portion of the sponge layer 100B being 6% or more, no color stripes or contamination arise over the entire axial direction region of the charging roller 14.

Here, in a case in which the thickness of the sponge layer 100B is 3 mm, as compared with a case in which the thickness of the sponge layer 100B is 2 mm, the compression rate is smaller by an amount corresponding to the amount that the thickness of the sponge layer is larger. Therefore, the range in which the condition $T\times\alpha/100>(R1+R2)-L>B>0$ is satisfied is wider than in the case of 2 mm. Hereinafter, description will be given of a case in which the thickness of the sponge layer 100B is 2 mm.

When the thickness of the sponge layer 101B is 2 mm, the maximum interference of the sponge layer 101B is $T\times\alpha/100=2\times0.56/100=1.12$ mm. Therefore, in Table 1, looking at cases in which the interference of the sponge layer 110B is 1 mm, 1.12 mm, and 1.25 mm, when the interference is 1.12 mm and 1.25 mm, at the end portions of the charging roller 14, filming of external additives and toner arise, the volume resistivity of the charging roller 14 rises, and, in particular, marked color stripes arise in an overall uniform image or the like. Namely, results supporting $T\times\alpha/100>(R1+R2)-L$ is obtained.

On the other hand, when the compression rate of the central portion of the sponge layer 100B is less than or equal to 5%, at the central portion of the charging roller 14, the occurrence of color stripes in the halftone image is seen, and contamination occurs at the central portion of the charging roller 14.

Figure 8:
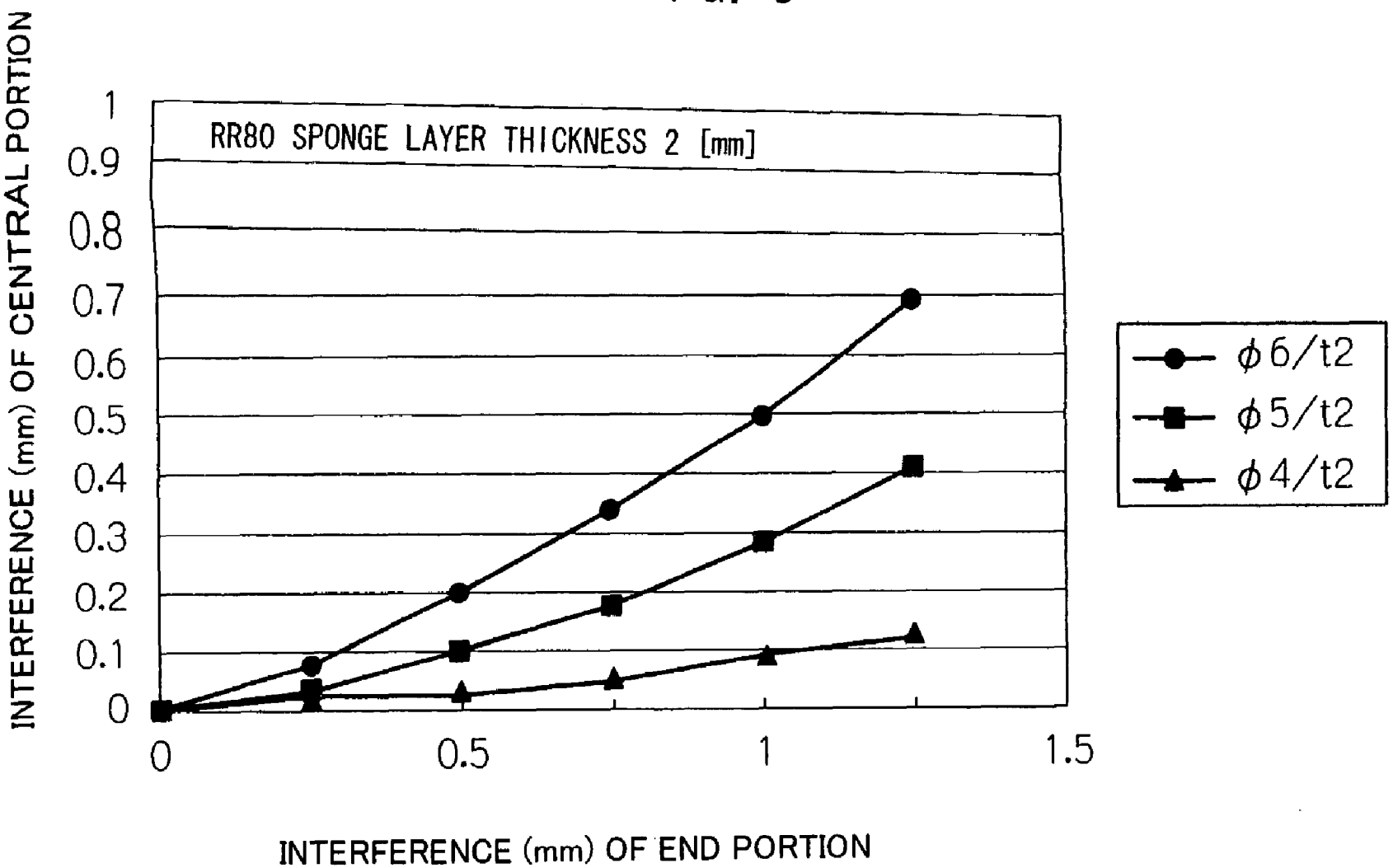
FIG. 8 is a graph comparing an interference at a central portion of and an interference at end portions of a sponge layer of the cleaning roller structuring the image forming device relating to the exemplary embodiment of the present invention.

FIG. 8 shows the results of comparing the interference at the central portion and the interference at the end portions of the sponge layer 101B when the outer diameter of the shaft 100A of the cleaning roller 100 is ϕ6, ϕ5, ϕ4.

From these results, it can be understood that the interference of the central portion of the sponge layer 100B is less than the interference of the end portions, and that, the smaller the outer diameter of the shaft 100A of the cleaning roller 100, the greater the ratio of the interference of the central portion and the interference of the end portions. Namely, the smaller the diameter of the shaft 100A, the greater the flexure amount of the shaft 100A, and the smaller the compression rate of the central portion of the sponge layer 110B.

There is tolerance in the outer diameter dimension of the sponge layer 110B. In particular in cases in which a small-diameter cleaning roller 100 (ϕ5 to ϕ15) is used, if the thickness of the sponge layer 100B is about 1 mm to 4 mm, the tolerance is 0.05 mm to 0.1 mm.

If the compression rate with respect to the thickness of the sponge layer 100B is converted from this tolerance, dispersion of 3% to 5% arises in the compression rate. Cases in which the compression rate is small are in particular affected by the tolerance.

Therefore, in Table 1, in cases in which the compression rate of the central portion of the sponge layer 100B is less than or equal to 5%, substantially, there is the possibility that a portion has arisen where the interference of the sponge layer 100B has become 0 in the peripheral direction (a portion where the sponge layer 100B has no interference with the charging roller 14). In cases in which the interference of the sponge layer 100B is 0 in the peripheral direction in this way, the ability to clean the charging roller 14 deteriorates, cleaning is not carried out well, and contamination of the charging roller 14 arises.

Accordingly, when taking the tolerance of the outer diameter dimension of the sponge layer 100B into consideration, the compression rate of the central portion of the sponge layer 100B must be made to be greater than 6%.

As shown in FIG. 6, given that the separation distance of the axial centers of the both end portions of the shaft 14A of the charging roller 14 and the shaft 100A of the cleaning roller 100 is designated L, and the radius of the charging roller 14 is designated R1, and the radius of the cleaning roller 100 is designated R2, the interference of the both end portions of the sponge layer 100B into the charging roller 14 is (R1+R2)−L.

Further, given that the flexure amount of the axial direction central portion of the shaft 100A is B, the interference of the central portion of the sponge layer 100B into the charging roller 14 is (R1+R2)−L−B, and is the minimum value when viewing the interferences at respective cross-sections along the axial direction of the shaft 100A.

Because this interference must be greater than 0, (R1+R2)−L−B>0, and the relationship (R1+R2)−L>B is obtained. Further, because the flexure amount B of the axial direction central portion of the shaft 100A is B>0, (R1+R2)−L>B>0.

From the above, the relationship T×α/100>(R1+R2)−L>B>0 is obtained. By satisfying this condition, a good ability to charge the photosensitive drum 12 by the charging roller 14, and a good ability to clean the charging roller 14 by the cleaning roller 100 can be obtained.

Further, it is possible to provide an image forming device 10 in which, even in cases in which the shaft 100A of the cleaning roller 100 has a small diameter, problems such as a deterioration in the cleaning ability, a rise in the resistance of the charging roller 14, the generation of stripes in the output image, and the like do not arise, and it is possible to provide the image forming device 10 which is compact and low-cost.

Detailed explanation in accordance with an exemplary embodiment of the present invention has been given above, but the present invention is not limited to the same, and various other forms can be implemented within the range of the present invention.

For example, the charging roller 14 is made to contact the lower portion of the photosensitive drum 12, and the cleaning roller 100 is made to contact the lower portion of the charging roller 14. However, the positional relationship between the photosensitive drum 12, the charging roller 14, and the cleaning roller 100 is not limited to the same. For example, the present invention can also be applied to a structure in which the charging roller is made to contact the upper portion of the photosensitive drum and the cleaning roller is made to contact the upper portion of the charging roller, or the like.

Further, in view of making the image forming device more compact, a charging roller being rotated by the photosensitive drum is exemplified as in the above-described exemplary embodiment. However, the image forming device may further include a dedicated driving mechanism which drives and rotates the charging roller.

Further, the image forming device which applies the present invention is not limited to the four-cycle-system structure in which the formation of a toner image onto the photosensitive drum 12 is repeated four times by using the rotary developing device 18, as in the above-described exemplary embodiment. For example, even in a structure in which yellow, magenta, cyan, and black image forming units are provided in parallel along the moving direction of an intermediate transfer belt, the present invention can be applied to the photosensitive drums, the charging rollers and the cleaning rollers of the respective image forming units.

The cleaning roller with the above-described configuration does not clean only the charging roller, but may also clean the surface of any rotatable body that rotates around a shaft.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

an image carrier that rotates by receiving driving force;

a charging roller that abuts and charges the image carrier, the charging roller including a shaft that is rotatably supported; and a cleaning roller that abuts and cleans the charging roller, the cleaning roller including a shaft that is rotatably supported, and a porous elastic layer being provided around the shaft;

wherein the image forming device satisfies the relation $$T\times\alpha/100>(R1+R2)-L>B>0$$

where L [mm] is a separation distance of axial centers of both end portions of the shaft of the cleaning roller and the shaft of the charging roller, R1[mm] is a radius of the charging roller, T [mm] is a thickness of the porous elastic layer, R2[mm] is a radius of the cleaning roller, B [mm] is a flexure amount of an axial direction central portion of the shaft of the cleaning roller, and α [%] is a maximum allowable compression rate in accordance with a stress-flexure curve when compressing the porous elastic layer with an applied stress which is 200% of an average stress P [kPa], the average stress P [kPa] being an average value of stresses at compression rates of the porous elastic layer of 10% to 40%.

2. The image forming device of claim 1, wherein the porous elastic layer is formed of a foam of a urethane rubber material or a urethane resin.

3. The image forming device of claim 1, wherein the porous elastic layer includes polyurethane.

4. The image forming device of claim 1, wherein the shaft of the cleaning roller comprises free-cutting steel or stainless steel.

5. The image forming device of claim 1, wherein the charging roller has a surface layer formed substantially of a fluorine resin or a silicone resin.

6. The image forming device of claim 5, wherein the surface layer includes a fluorine-modified acrylate polymer.

7. The image forming device of claim 1, wherein the charging roller is rotated by the image carrier.

8. The image forming device of claim 1, wherein the charging roller is rotated by a drive mechanism.

9. A charging device comprising:

a charging roller that abuts an image carrier on which a toner image is to be formed, and charges the image carrier, the charging roller including a shaft that is rotatably supported; and a cleaning roller that abuts and cleans the charging roller, the cleaning roller including a shaft that is rotatably supported, and a porous elastic layer being provided around the shaft wherein the image forming device satisfies the relation $$T\times\beta/100>(R1+R2)-L>B>0$$

where L [mm] is a separation distance of axial centers of both end portions of the shaft of the cleaning roller and the shaft of the charging roller, R1[mm] is a radius of the charging roller, T [mm] is a thickness of the porous elastic layer, R2[mm] is a radius of the cleaning roller, B [mm] is a flexure amount of an axial direction central portion of the shaft of the cleaning roller, and α [%] is a maximum allowable compression rate in accordance with a stress-flexure curve when compressing the porous elastic layer with an applied stress which is 200% of an average stress P [kPa], the average stress P [kPa] being an average value of stresses at compression rates of the porous elastic layer of 10% to 40%.

10. The charging device of claim 9, wherein the porous elastic layer is formed of a foam of a rubber material or a urethane resin.

11. The charging device of claim 9, wherein the porous elastic layer includes polyurethane.

12. The charging device of claim 9, wherein the shaft of the cleaning roller comprises free-cutting steel or stainless steel.

13. The charging device of claim 9, wherein the charging roller has a surface layer formed substantially of a fluorine resin or a silicone resin.

14. The charging device of claim 13, wherein the surface layer includes a fluorine-modified acrylate polymer.

15. The charging device of claim 9, wherein the charging roller is rotated by the image carrier.

16. The charging device of claim 9, wherein the charging roller is rotated by a drive mechanism.

17. A cleaning device for cleaning a rotatable body having a shaft that is rotatably supported, the cleaning device comprising:

a cleaning roller that abuts and cleans the rotatable body, the cleaning roller including a shaft which is rotatably supported, and a porous elastic layer being provided around the shaft, wherein the cleaning device satisfies the relation $$T\times\alpha/100>(R1+R2)-L>B>0$$

where L [mm] is a separation distance of axial centers of both end portions of the shaft of the cleaning roller and the shaft of the rotatable body, R1 [mm] is a radius of the rotatable body, T [mm] is a thickness of the porous elastic layer, R2[mm] is a radius of the cleaning roller, B [mm] is a flexure amount of an axial direction central portion of the shaft of the cleaning roller, and α [%] is a maximum allowable compression rate in accordance with a stress-flexure curve when compressing the porous elastic layer with an applied stress which is 200% of an average stress P [kPa], the average stress P [kPa] being an average value of stresses at compression rates of the porous elastic layer of 10% to 40%.

18. The cleaning device of claim 17, wherein the porous elastic layer is formed of a foam of a rubber material or a urethane resin.

19. The cleaning device of claim 17, wherein the porous elastic layer includes polyurethane.

20. The cleaning device of claim 17, wherein the shaft of the cleaning roller comprises free-cutting steel or stainless steel.

* * * * *